US008325171B2

(12) United States Patent
Chen et al.

(10) Patent No.: US 8,325,171 B2
(45) Date of Patent: Dec. 4, 2012

(54) DISPLAY DEVICE AND DISPLAY DRIVING METHOD

(75) Inventors: Yu-Cheng Chen, Hsin-Chu (TW); Yi-Chen Chiang, Hsin-Chu (TW); Chun-Ting Liu, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 366 days.

(21) Appl. No.: 12/684,903

(22) Filed: Jan. 9, 2010

(65) Prior Publication Data

US 2011/0169787 A1 Jul. 14, 2011

(30) Foreign Application Priority Data

Jul. 1, 2009 (TW) ..... 98122242 A

(51) Int. Cl.
*G09G 3/20* (2006.01)

(52) U.S. Cl. ..... 345/204; 345/55

(58) Field of Classification Search ..... 345/204, 345/55

See application file for complete search history.

(56) References Cited

U.S. PATENT DOCUMENTS 4,986,637 A * 1/1991 Yamaguchi ..... 349/109
5,341,151 A * 8/1994 Knapp ..... 345/58
6,072,457 A * 6/2000 Hashimoto et al. ..... 345/100
6,727,875 B1 * 4/2004 Mikami et al. ..... 345/92
6,995,394 B2 2/2006 Hong et al.
7,982,219 B2 * 7/2011 Kuo et al. ..... 257/59
2005/0083319 A1 * 4/2005 Kodate et al. ..... 345/204
2006/0138414 A1 6/2006 Hong et al.
2010/0110114 A1 * 5/2010 Hashimoto ..... 345/691
2010/0149157 A1 * 6/2010 Shih et al. ..... 345/211
2010/0283714 A1 * 11/2010 Cho et al. ..... 345/90

* cited by examiner

*Primary Examiner* — Alexander Eisen
*Assistant Examiner* — Christopher E Leiby
(74) *Attorney, Agent, or Firm* — Chun-Ming Shih

(57) ABSTRACT

An exemplary display device includes multiple pixels, first through third gate lines and a data line. The pixels include first through third pixels. The first through third gate lines respectively are electrically coupled with the first through third pixels and for deciding whether to enable the first through third pixels. The first pixel is electrically coupled to the data line to receive a display data provided by the data line. The second pixel is electrically coupled to the first pixel to receive a display data provided by the data line through the first pixel. The third pixel is electrically coupled to the second pixel to receive a display data provided by the data line through both the first pixel and the second pixel. A display driving method adapted to be implemented in the display device also is provided.

22 Claims, 7 Drawing Sheets

DISPLAY DEVICE AND DISPLAY DRIVING METHOD

CROSS-REFERENCE TO RELATED APPLICATIONS

This application is based upon and claims the benefit of priority from the prior Taiwanese Patent Application No. 098122242, filed Jul. 1, 2009, the entire contents of which are incorporated herein by reference.

BACKGROUND

1. Technical Field

The present invention generally relates to display technology fields and, particularly to a display device and a display driving method.

2. Description of the Related Art

An active-type matrix display device generally includes a substrate, a gate driver(s), a source driver(s) and a plurality of pixels. The gate driver(s), the source driver(s) and the pixels are formed on the substrate. The gate driver(s) is/are for generating gate driving signals and supplying the gate driving signals to a plurality of gate lines through gate fan-out lines to decide whether to enable the pixels electrically coupled with the gate lines. The source driver(s) is/are for supplying the pixels with display data through multiple data lines formed on the substrate for the purpose of image display.

In the active-type matrix display device, since the cost of the source drivers is relatively high, a display device with half-source driving structure has been proposed in the prior art. The display device with half-source driving structure employs a pixel arrangement of each two pixels serially connected with each other to halve the amount of data lines of the display device so that the amount of the source drivers is halved or to halve the area of integrated circuit(s), and the cost is reduced in some degree as a result.

However, the pixel arrangement of the above-mentioned display device with half-source driving structure takes two series-connected pixels as one cycle, since the arrangement of RGB three-colored pixels takes three pixels as one cycle, such pixel arrangement of taking two series-connected pixels as one cycle makes it is difficult to perform gamma curve correction for single color and thus a special driving means of driving the pixels arranged at two opposite sides of a data line and electrically coupled to the data line with Zigzag mode is necessary during the gamma curve correction, or else the color unevenness (e.g., line mura) would be caused to occur and the display quality is degraded.

BRIEF SUMMARY

The present invention is directed to a display device, so as to further reduce the cost and improve the display quality.

The present invention is further directed to a display driving method, so as to further reduce the cost and improve the display quality of display device.

In order to achieve the above-mentioned objective, or to achieve other objectives, a display device in accordance with a first embodiment of the present invention is provided. The display device includes: a plurality of pixels, a first gate line, a second gate line, a third gate line and a data line. The pixels include a first pixel, a second pixel and a third pixel. The first gate line, the second gate line and the third gate line respectively are electrically coupled to the first pixel, the second pixel and the third pixel and for deciding whether to enable the first pixel, the second pixel and the third pixel. The first pixel is electrically coupled to the data line to receive a display data provided by the data line, the second pixel is electrically coupled to the first pixel to receive a display data provided by the data line through the first pixel, and the third pixel is electrically coupled to the second pixel to receive a display data provided by the data line through both the first pixel and the second pixel.

In one embodiment, the pixels of the display device are colored pixels, and at least two of the first pixel, the second pixel and the third pixel are for displaying different colors. Moreover, the colored pixels are arranged in a strip manner or arranged in delta manner.

In one embodiment, the first pixel, the second pixel and the third pixel are arranged in different columns from one another, the columns substantially extending along an extension direction of the data line. In another embodiment, the first pixel, the second pixel and the third pixel are arranged in two columns.

In one embodiment, the third pixel of the display device includes a pixel transistor and a pixel electrode electrically coupled to the pixel transistor, the pixel electrode and the pixel transistor are arranged at two opposite sides of the third gate line.

In one embodiment, the second gate line is neighboring with both the first gate line and the third gate line and located between the first gate line and the third gate line.

In one embodiment, the display device further includes another data line neighboring with the above-mentioned data line, the first pixel, the second pixel and the third pixel are arranged between the two data line. Moreover, the two data lines have two gate fan-out lines arranged therebetween.

Furthermore, a display driving method adapted to be implemented in the display device in accordance with the first embodiment of the present invention is provided. The display driving method includes the step of: sequentially supplying a driving signal to the third gate line, the second gate line and the first gate line in that order, wherein the driving signal includes a first pulse, a second pulse and a third pulse sequentially generated in that order, pulse widths of the first pulse, the second pulse and the third pulse in that order are progressively increased, and time intervals among the first pulse, the second pulse and the third pulse in that order are progressively decreased. The first pulse of the driving signal supplied to the first gate line has a partial time overlap with each of the third pulse of the driving signal supplied to the third gate line and the second pulse of the driving signal supplied to the second gate line; the second pulse of the driving signal supplied to the first gate line is behind the third pulse of the driving signal supplied to the third gate line and has a partial time overlap with the third pulse of the driving signal supplied to the second gate line; and the third pulse of the driving signal supplied to the first gate line is behind the third pulse of the driving signal supplied to the second gate line. Moreover, the display driving method can further include the step of: providing display data with different polarities respectively to the two neighboring data lines of the above-mentioned display device.

In order to achieve the above-mentioned objective, or to achieve other objectives, a display device in accordance with a second embodiment of the present invention is provided. The display device includes: a plurality of pixels, a first gate line, a second gate line, a third gate line and a data line. The pixels include a first pixel, a second pixel and a third pixel. Each of the first pixel, the second pixel and the third pixel includes a pixel transistor and a pixel electrode electrically coupled to a first source/drain electrode of the pixel transistor. The first gate line is electrically coupled to the gate electrode of the pixel transistor of the first pixel, the second gate line is electrically coupled to the gate electrode of the pixel transistor of the second pixel, and the third gate line is electrically coupled to the gate electrode of the pixel transistor of the third pixel. The second source/drain electrode of the pixel transistor of the first pixel is electrically coupled to the data line, the second source/drain electrode of the pixel transistor of the second pixel is electrically coupled to the first source/drain electrode of the pixel transistor of the first pixel, and the second source/drain electrode of the pixel transistor of the third pixel is electrically coupled to the first source/drain electrode of the pixel transistor of the second pixel.

Furthermore, a display driving method adapted to be implemented in the above-mentioned display device in accordance with the second embodiment of the present invention also is provided. The display driving method includes the step of: sequentially providing a driving signal to the third gate line, the second gate line and the first gate line in that order, wherein the driving signal includes a first pulse, a second pulse and a third pulse sequentially generated in that order, pulse widths of the first pulse, the second pulse and the third pulse in that order are progressively increased and time intervals among the first pulse, the second pulse and the third pulse in that order are progressively decreased. The first pulse of the driving signal provided to the first gate line has a partial time overlap with each of the third pulse of the driving signal provided to the third gate line and the second pulse of the driving signal provided to the second gate line; the second pulse of the driving signal provided to the first gate line is behind the third pulse of the driving signal provided to the third gate line and has a partial time overlap with the third pulse of the driving signal provided to the second gate line; and the third pulse of the driving signal provided to the first gate line is behind the third pulse of the driving signal provided to the second gate line. Moreover, the display driving method can further include the step of: providing display data with different polarities respectively to the two neighboring data lines of the above-mentioned display device.

In order to achieve the above-mentioned objective, or to achieve other objectives, a display device in accordance with a third embodiment of the present invention is provided. The display device includes: a substrate, a plurality of pixels, a plurality of gate lines and a plurality of data lines. The pixels are formed on the substrate. The gate lines are formed on the substrate and for deciding whether to enable the pixels. The data lines are formed on the substrate and intersecting with the gate lines, and for supplying display data to the pixels. Each two neighboring ones of at least a part of the data lines have one or multiple gate fan-out lines arranged therebetween, and each of the gate fan-out lines is electrically coupled to a corresponding one of the gate lines. Moreover, the pixels can be colored pixels and arranged in a strip manner or a delta manner.

In one embodiment, the pixels include a first pixel and a plurality of series-connected second pixels. The first pixel is electrically coupled to a particular one of the data lines to receive a display data provided by the particular data line. One of the second pixels is electrically coupled to the first pixel and thereby the second pixels receive display data provided by the particular data line through the first pixel.

In one embodiment, the first pixel and the second pixels are arranged in different columns from one another, the columns substantially extending along an extension direction of the particular data line. In another embodiment, the first pixel and the second pixels are arranged in two columns.

In one embodiment, the first pixel and the second pixels are colored pixels, and at least two of the first pixel and the second pixels are for displaying different colors.

In one embodiment, the gate fan-out lines are formed an opaque region of the display device.

In the above-mentioned embodiments of the present invention, by employing the pixel arrangement of at least three pixels serially connected with one by another, the display device can save ⅔ and even more data lines and thus the cost of the display device can be further reduced. Moreover, the above-mentioned embodiments can achieve better display qualities, for example, when the pixel arrangement of the display device takes three series-connected pixels as one cycle, since the arrangement of RGB three-colored pixels also takes three pixels as one cycle, the display driving for the display device still can be completed even if without the use of the driving means of alternately driving pixels arranged at two opposite sides of each data line and electrically coupled to the data line (hereinafter, termed as Zigzag driving), which makes it is easily to perform gamma curve correction for single color. Furthermore, since ⅔ and even more data lines can be saved, it is feasible that all of gate fan-out lines of the display device are arranged in the display area and no gate fan-out line is arranged in the border outside the display area, which facilitates the employment of narrow border designs and the uneven brightness issue resulting from the gate fan-out lines would not completely (i.e., only partially) be arranged in the display area no longer exists.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
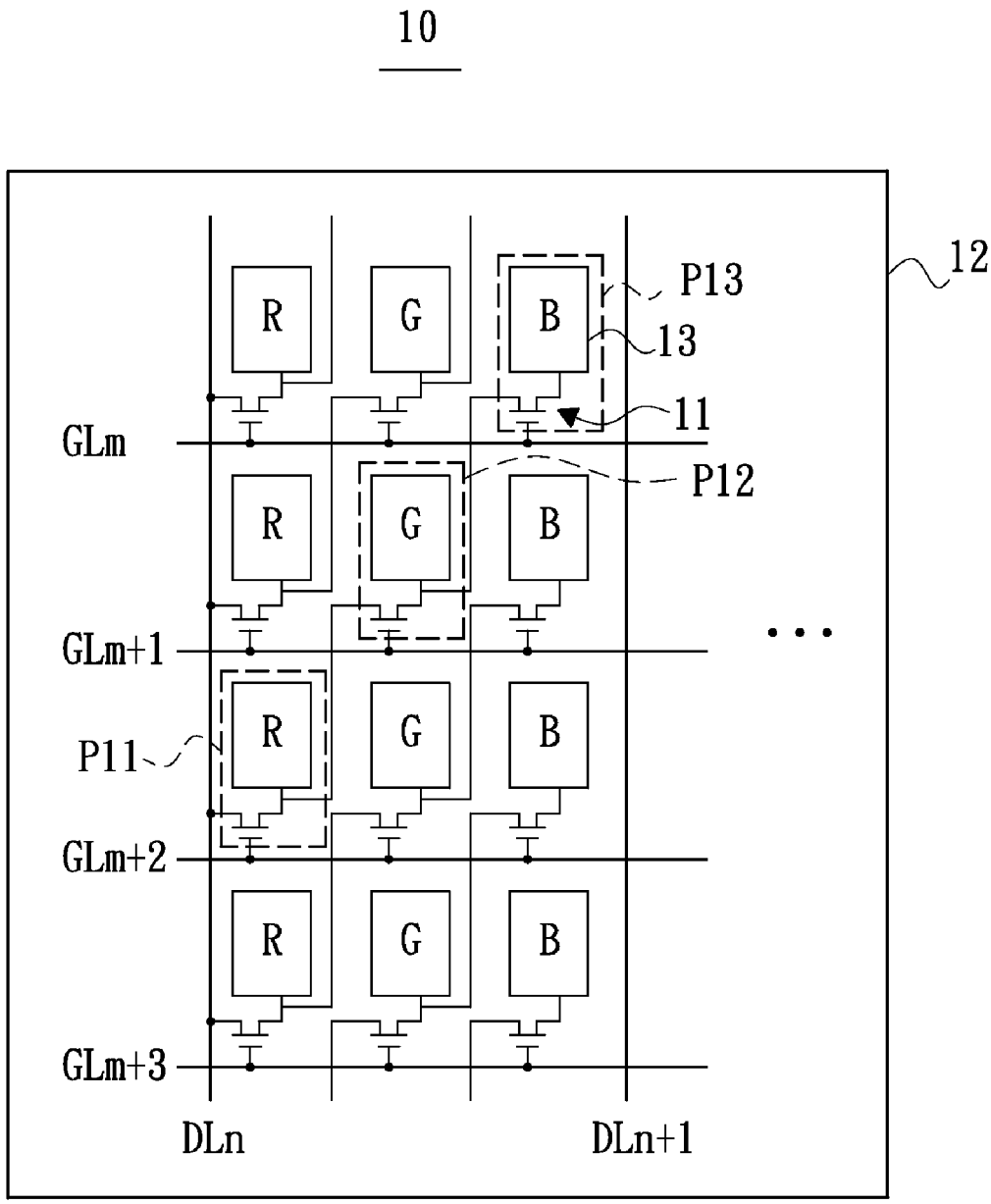
FIG. 1 is a schematic partial view of a display device in accordance with an embodiment of the present invention.

Referring to FIG. 1, a schematic partial view of a display device in accordance with an embodiment of the present invention is shown. The display device 10 includes a substrate 12, multiple gate lines Gm, Gm+1, Gm+2, Gm+3, multiple data lines DLn, DLn+1 and multiple pixels R, G, B. The gate lines Gm, Gm+1, Gm+2, Gm+3, the data lines DLn, DLn+1 and the pixels R, G, B all are formed on the substrate 12. The pixels R, G, B are colored pixels and arranged in a strip manner. The gate lines Gm, Gm+1, Gm+2, Gm+3 are for deciding whether to enable the pixels R, G, B. The data lines DLn, DLn+1 are for supplying display data to the pixels R, G, B for the purpose of image display. For the purpose of simplified description, hereinafter only three series-connected pixels P11, P12 and P13 are taken for an example to describe a pixel arrangement of the display device 10 in accordance with the embodiment of the present invention, in detail.

Still referring to FIG. 1, the gate line GLm+1 is neighboring with both the gate line GLm and the gate lines GLm+2 and arranged between the gate line GLm and the gate line Gm+2. The gate lines GLm+2, GLm+1 and GLm respectively are electrically coupled to the pixels P11, P12 and P13 and for deciding whether to enable the pixels P11, P12 and P13. The pixel P11 is electrically coupled to the data line DLn to receive a display data provided by the data line DLn. The pixel P12 is electrically coupled to the pixel P11 to receive a display data provided by the data line DLn through the pixel P11. The pixel P13 is electrically coupled to the pixel P12 to receive a display data provided by the data line DLn through both the pixels P11 and P12.

More specifically, the pixels P11, P12 and P13 are arranged between the two data lines DLn and DLn+1. Each of the pixels P11, P12 and P13 includes a pixel transistor 11 and a pixel electrode 13 electrically coupled to the drain electrode of pixel transistor 11. The gate line GLm+2 is electrically coupled to the gate electrode of the pixel transistor 11 of the pixel P11. The gate line GLm+1 is electrically coupled to the gate electrode of the pixel transistor 11 of the pixel P12. The gate line GLm is electrically coupled to the gate electrode of the pixel transistor 11 of the pixel P13. The source electrode of the pixel transistor 11 of the pixel P11 is electrically coupled to the data line DLn. The source electrode of the pixel transistor 11 of the pixel P12 is electrically coupled to the drain electrode of the pixel transistor 11 of the pixel P11. The source electrode of the pixel transistor 11 of the pixel P13 is electrically coupled to the drain electrode of the pixel transistor 11 of the pixel P12.

Moreover, the pixels P11, P12 and P13 are for displaying three different colors e.g., red (R), green (G) and blue (B) colors from one another. The pixels P11, P12 and P13 are arranged in different columns from one another and the columns extend along an extension direction of the data line DLn, i.e., the vertical direction in FIG. 1.

Figure 2:
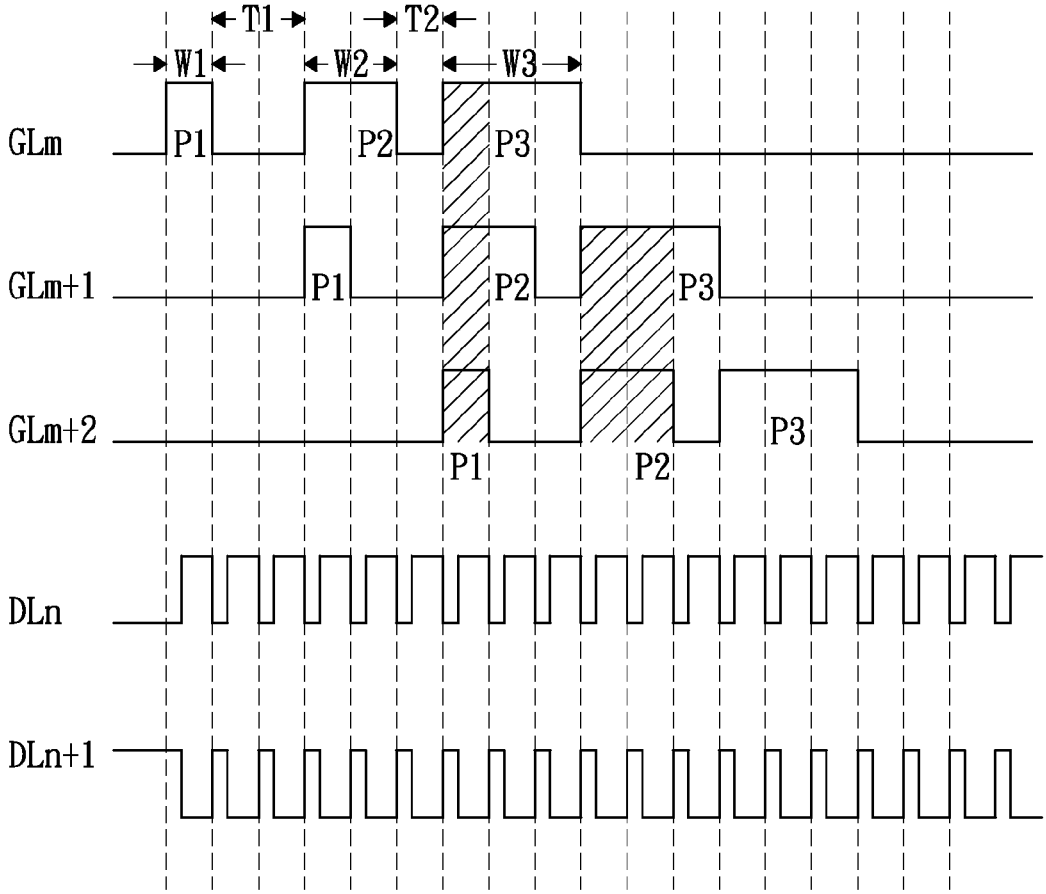
FIG. 2 shows timing diagrams of a driving signal sequentially supplied to multiple gate lines and display data supplied to multiple data lines in a display driving method in accordance with an embodiment of the present invention.

A display driving method adapted to be implemented in the display device 10 will be described below in detail with reference to FIG. 2. FIG. 2 shows timing diagrams of a driving signal sequentially supplied to the respective gate lines GLm, GLm+1, GLm+2 and display data supplied to the data lines DLn, DLn+1. As seen from FIG. 2, the driving signal sequentially supplied to the gate lines GLm, GLm+1, GLm+2 includes pulses P1, P2, P3 sequentially generated in that order. Pulse widths of the pulses P1, P2 and P3 in that order are progressively increased, i.e., W3>W2>W1, and time intervals among the pulses P1, P2 and P3 in that order are progressively decreased, i.e., T2<T1. The pulse P1 of the driving signal supplied to the gate line GLm+2 has a partial time overlap with each of the pulse P3 of the driving signal supplied to the gate line GLm and the pulse P2 of the driving signal supplied to the gate line GLm+1. The pulse P2 of the driving signal supplied to the gate line GLm+2 is behind the pulse P3 of the driving signal supplied to the gate line GLm and has a partial time overlap with the pulse P3 of the driving signal supplied to the gate line GLm+1. The pulse P3 of the driving signal supplied to the GLm+2 is behind the pulse P3 of the driving signal supplied to the gate line GLm+1. The display data respectively provided to the two data lines DLn and DLn+1 have different polarities.

Figure 3:
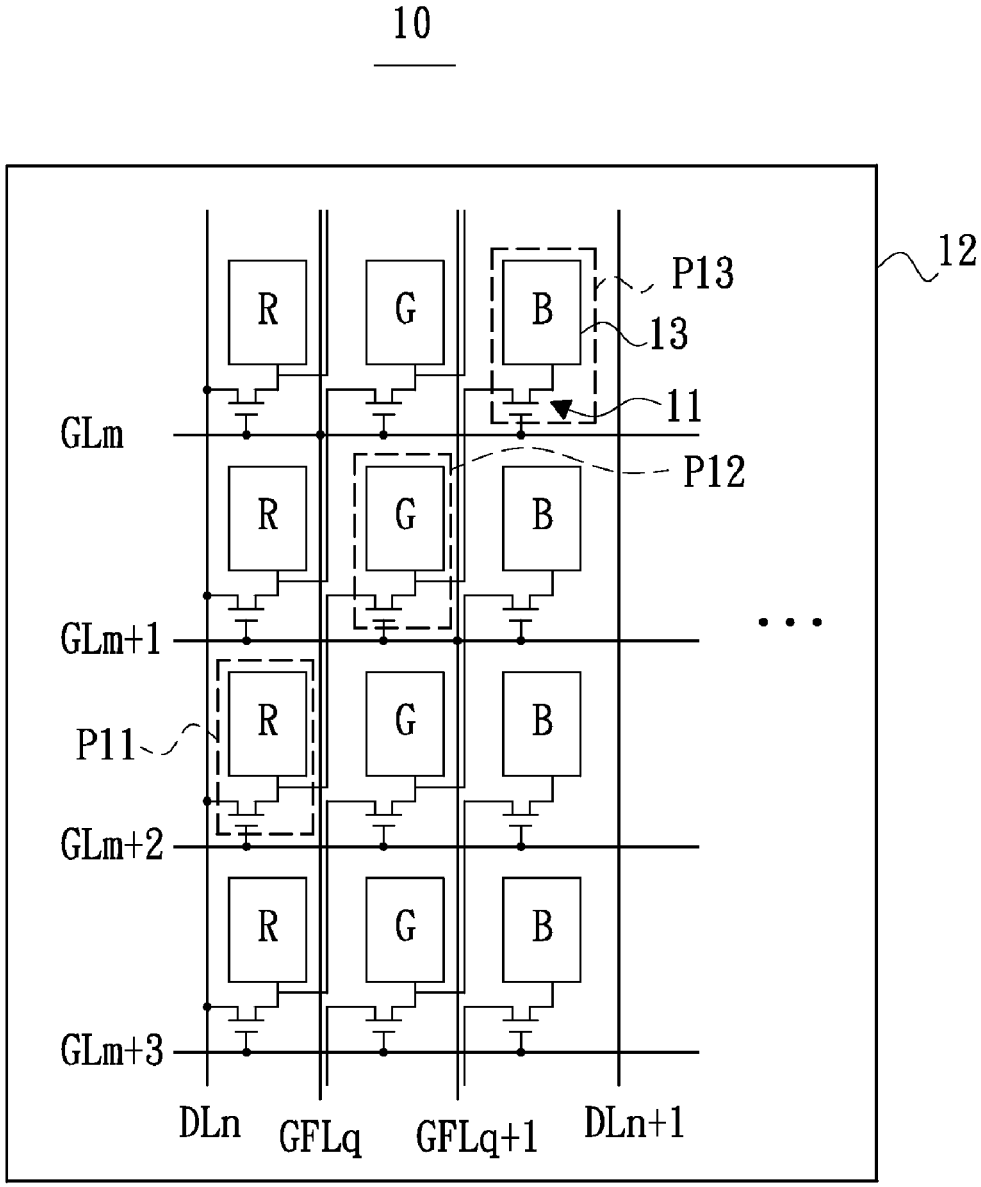
FIG. 3 is a schematic partial view of a display device in accordance with another embodiment of the present invention.

In addition, referring to FIG. 3, the display device 10 in accordance with the embodiment of the present invention can further include two gate fan-out lines GFLq and GFLq+1 arranged between the two neighboring data lines DLn and DLn+1. The gate fan-out lines GFLq and GFLq+1 are respectively electrically coupled to the gate lines GLm and GLm+1 and arranged in an opaque region of the display device 10, e.g., black matrix region.

Figure 4:
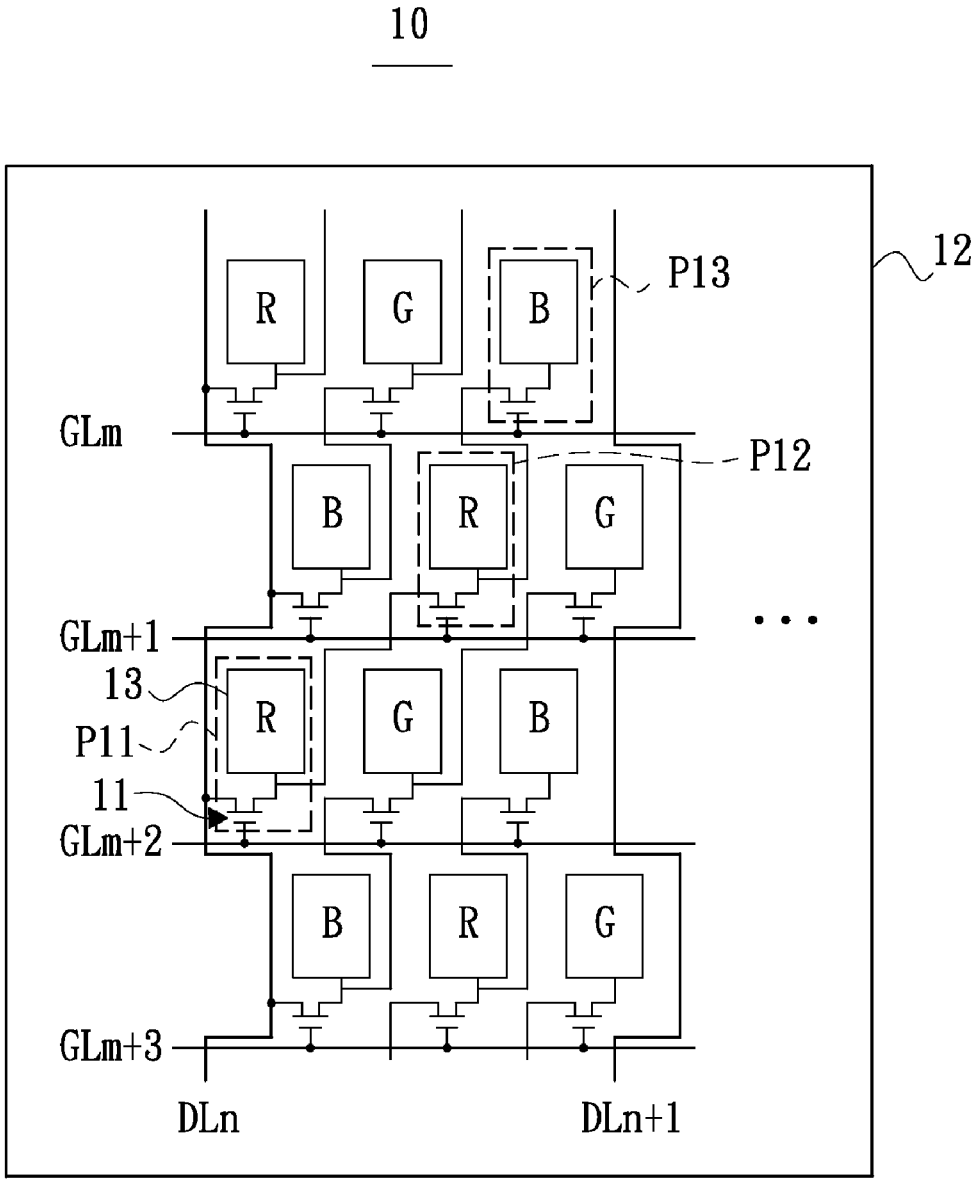
FIG. 4 is a schematic partial view of a display device in accordance with still another embodiment of the present invention.

Referring to FIG. 4, the pixels R, G, B of the display device 10 in accordance with the embodiment of the present invention are not limited to be arranged in the strip manner, and can be arranged in a delta manner as illustrated in FIG. 4 instead. As illustrated in FIG. 4, the three series-connected pixels P11, P12 and P13 are for displaying two different colors, e.g., red and blue colors. The pixels P11, P12 and P13 are arranged in different columns from one another and the columns extend along the extension direction of the data line DLn. Herein, although the data line DLn has bending portions, the extension direction of the data line DLn substantially still is the vertical direction in FIG. 4.

Figure 5:
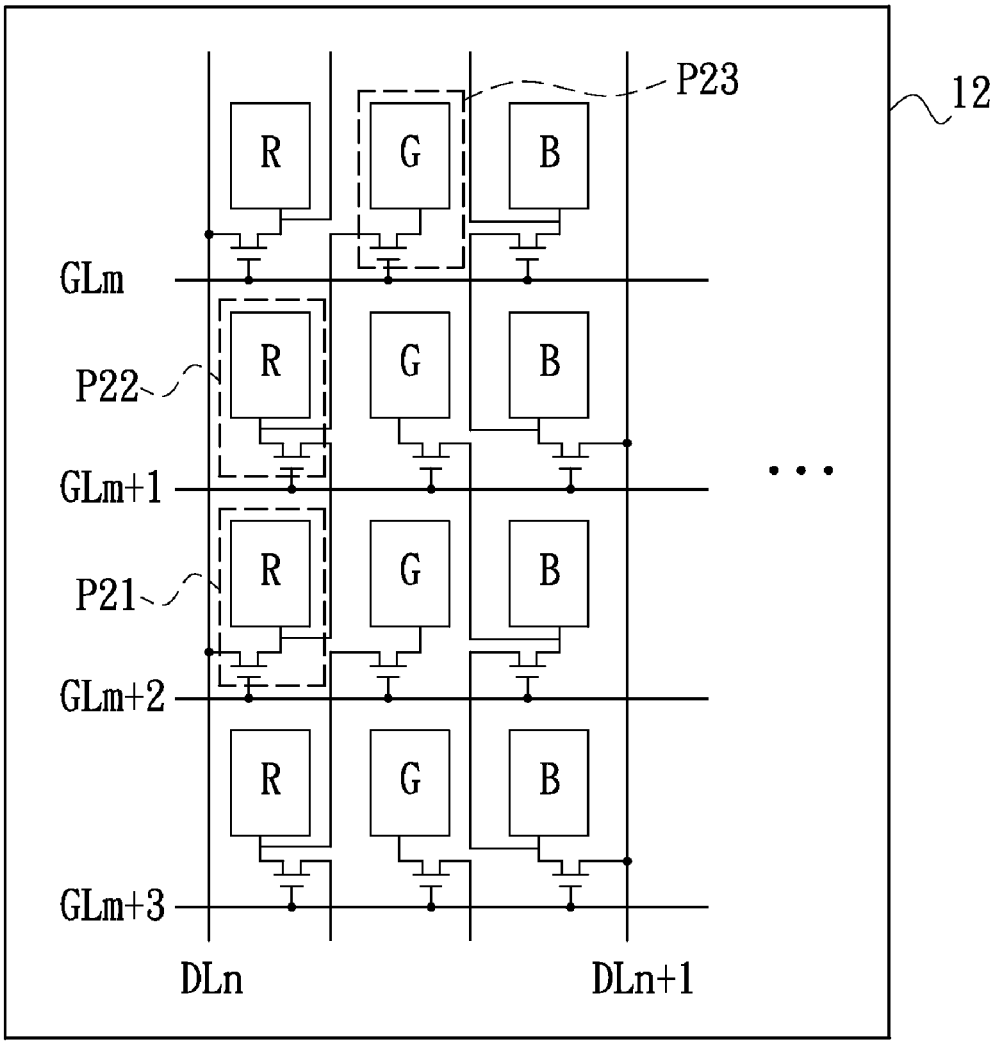
FIG. 5 is a schematic partial view of a display device in accordance with further still another embodiment of the present invention.
Figure 6:
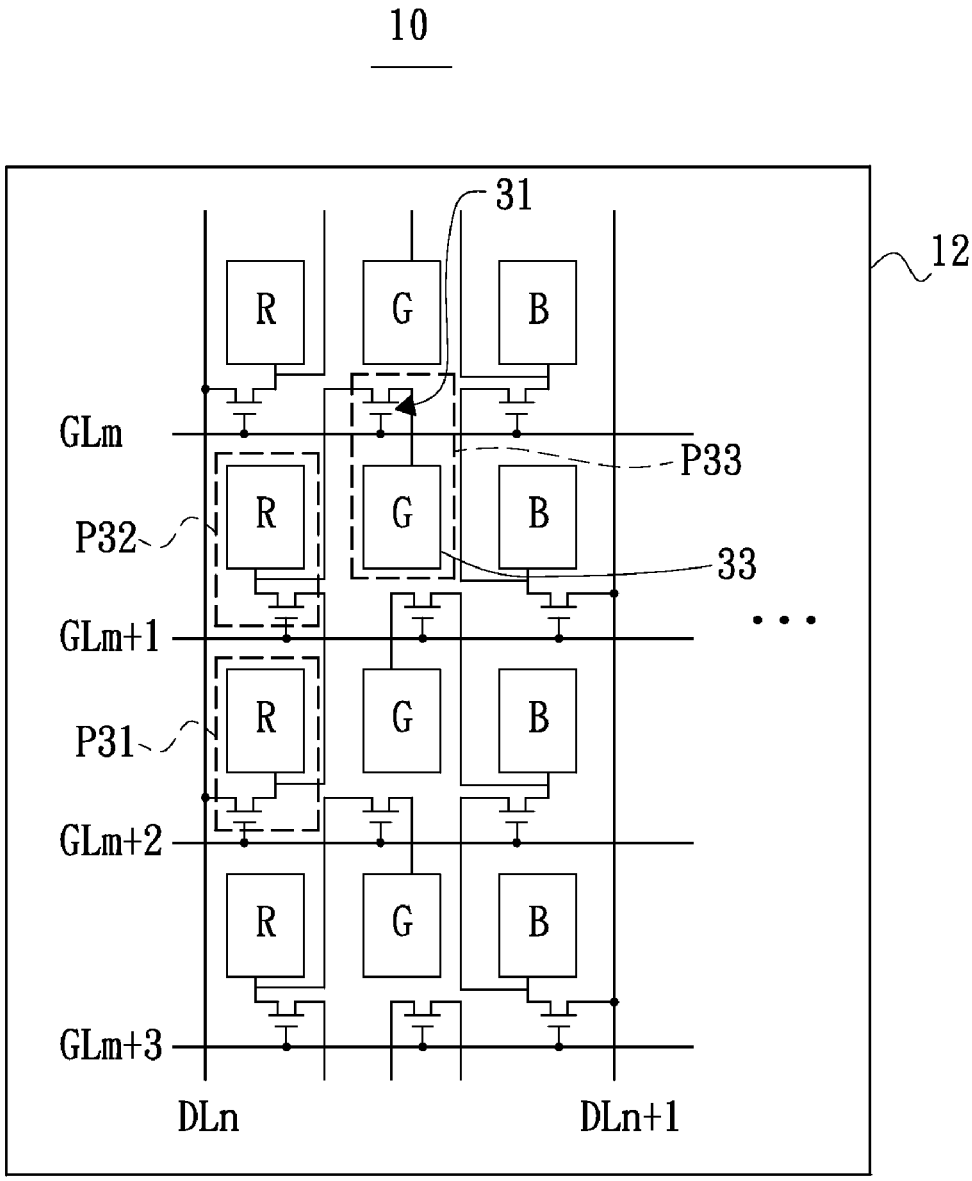
FIG. 6 is a schematic partial view of a display device in accordance with even further still another embodiment of the present invention.

Further, the pixel arrangement of the display device 10 can employ other designs, e.g., the illustration in FIG. 5. The pixels R, G, B of the display 10 in FIG. 5 are arranged in a strip manner, three series-connected pixels P21, P22, P23 of the pixels R, G, B are arranged in two columns and the columns extend along the extension direction of the data line DLn, i.e., the vertical direction in FIG. 5. The pixels P21, P22 and P23 are for displaying two different colors, e.g., red and green colors. In another embodiment, as illustrated in FIG. 6, the pixels R, G, B of the display device 10 are arranged in a strip manner, the three series-connected pixels P31, P32 and P33 of the pixels R, G, B are arranged in two columns and the columns extend along the extension direction of the data line DLn, i.e., the vertical direction in FIG. 6. The pixels P31, P32 and P33 are for displaying two different colors, e.g., red and green colors. The pixel transistor 31 and the pixel electrode 33 of the pixel 33 are located at two opposite sides of the gate line GLm.

Figure 7:
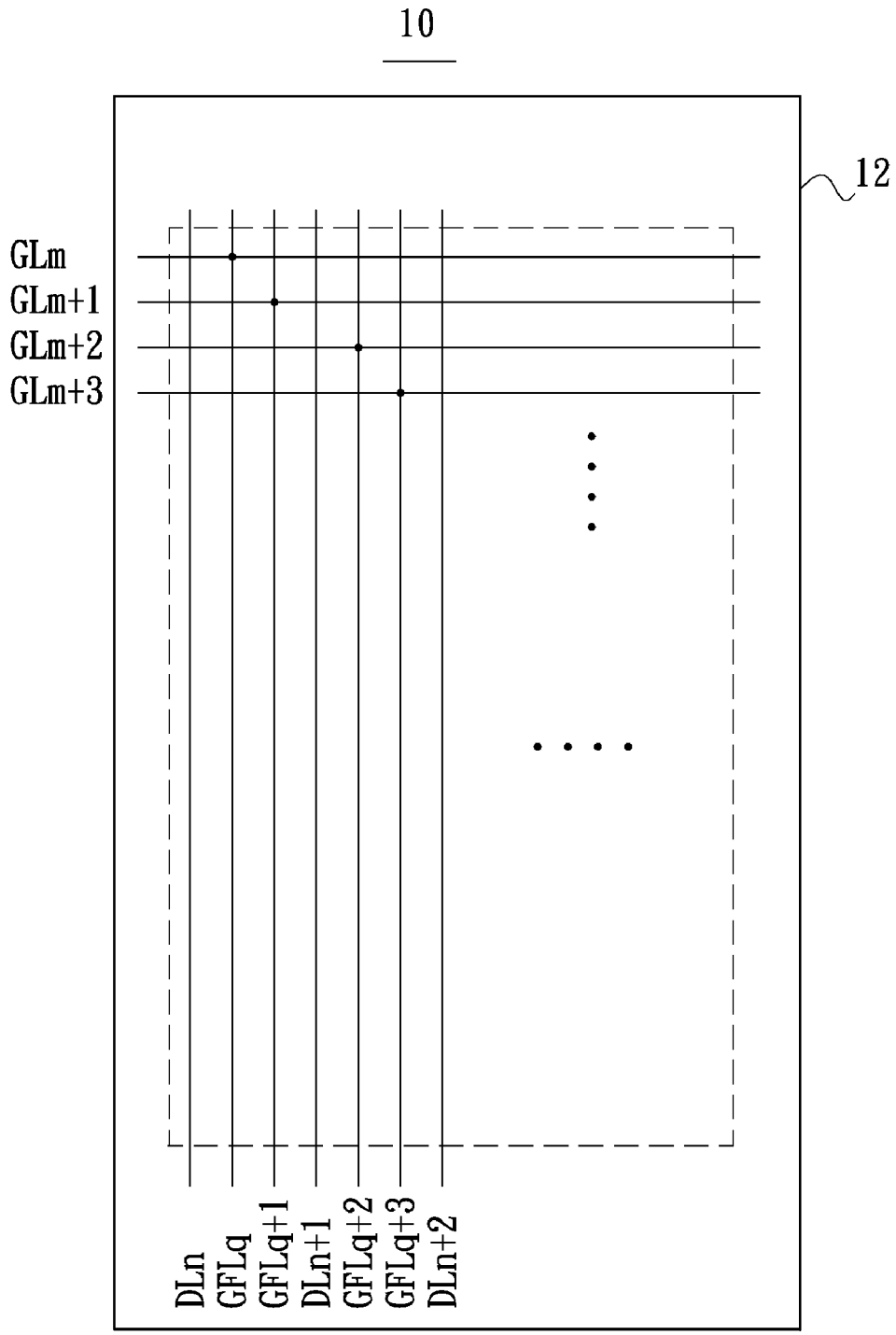
FIG. 7 shows relative positional relationships among multiple gate lines, multiple gate fan-out lines and multiple data lines in accordance with an embodiment of the present invention.

Referring to FIG. 7, relative positional relationships among multiple gate lines, multiple gate fan-out lines and multiple data lines are shown. As illustrated in FIG. 7, the data lines DLn, DLn+1, DLn+2 and the gate lines GLm, GLn+1, GLm+2, GLm+3 are formed on the substrate 12 of the display device 12 and intersecting with each other. Each two neighboring ones of the data lines DLn, DLn+1, DLn+2 have two gate fan-out lines arranged therebetween. In particular, the data line DLn and the data line DLn+1 have two gate fan-out lines GFLq, GFLq+1 arranged therebetween. The gate fan-out lines GFLq, GFLq+1 respectively are electrically coupled to the gate lines GLm, GLm+1 and for supplying driving signals to the gate lines GLm, GLm+1. The data line DLn+1 and the data line DLn+2 have two gate fan-out lines GFLq+2, GFLq+3 arranged therebetween. The gate fan-out lines GFLq+2, GFLq+3 respectively are electrically coupled to the gate lines GLm+2, GLm+3 and for supplying driving signals to the gate lines GLm+2, GLm+3.

It is noted that, the multiple data lines of the display device 10 in FIG. 7 are not limited to each two neighboring ones of them have two gate fan-out lines arranged therebetween, and can be each two neighboring ones of only a part of them have one or multiple (i.e., two or more) gate fan-out lines arranged therebetween according to practical requirements.

In addition, the display device 10 in accordance with the embodiment of the present invention is not limited to use R, G, B three-colored pixels, and can use four-colored pixels or more-than-four-colored pixels, and the pixel arrangement of the display device can use four even more series-connected pixels as one cycle. Correspondingly, each two neighboring ones of at least a part of the pixels of the display device can have three even more gate fan-out lines arranged therebetween.

In summary, in the above-mentioned embodiments of the present invention, by employing the pixel arrangement of at least three pixels serially connected with one by another, the display device can save ⅔ and even more data lines and thus the cost of the display device can be further reduced. Moreover, the above-mentioned embodiments can achieve better display qualities, for example, when the pixel arrangement of the display device takes three series-connected pixels as one cycle, since the arrangement of RGB three-colored pixels also takes three pixels as one cycle, so that it is easily to perform gamma curve correction for single color. Furthermore, since ⅔ and even more data lines can be saved, it is feasible that all of gate fan-out lines of the display device are arranged in the display area (as depicted by the dashed rectangle in FIG. 7) and no gate fan-out line is arranged in the border outside the display area, which facilitates the employment of narrow border design and the uneven brightness issue resulting from the gate fan-out lines would not completely (i.e., only partially) be arranged in the display area no longer exists.

Additionally, the skilled person in the art can make some modifications with respect to the display device and the display driving method in accordance with the above-mentioned embodiments, for example, suitably changing the pixel arrangement of the display device, interchanging the electrical connections of the source electrodes and the drain electrodes of the respective pixel transistors, and so on, as long as such modification(s) would not depart from the scope and spirit of the present invention.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A display device comprising:

a plurality of pixels, comprising a first pixel, a second pixel and a third pixel;

a first gate line, electrically coupled to the first pixel and for deciding whether to enable the first pixel;

a second gate line, electrically coupled to the second pixel and for deciding whether to enable the second pixel;

a third gate line, electrically coupled to the third pixel and for deciding whether to enable the third pixel; and a data line;

wherein the first pixel is electrically coupled to the data line to receive a display data provided by the data line, the second pixel is electrically coupled to the first pixel to receive a display data provided by the data line through the first pixel, the third pixel is electrically coupled to the second pixel to receive a display data provided by the data line through both the first pixel and the second pixel, and the third pixel comprises a pixel transistor and a pixel electrode electrically coupled to the pixel transistor, the pixel electrode and the pixel transistor are arranged at two opposite sides of the third gate line.

2. The display device as claimed in claim 1, wherein the pixels are colored pixels, and at least two of the first pixel, the second pixel and the third pixel are for displaying different colors.

3. The display device as claimed in claim 2, wherein the colored pixels are arranged in a strip manner.

4. The display device as claimed in claim 2, wherein the colored pixels are arranged in a delta manner.

5. The display device as claimed in claim 1, wherein the first pixel, the second pixel and the third pixel are arranged in different columns from one another, and the columns extend along an extension direction of the data line.

6. The display device as claimed in claim 1, wherein the first pixel, the second pixel and the third pixel are arranged in two columns, and the columns extend along an extension direction of the data line.

7. The display device as claimed in claim 1, wherein the second gate line is neighboring with both the first gate line and the third gate line and arranged between the first gate line and the third gate line.

8. The display device as claimed in claim 1, further comprising another data line neighboring with the data line, wherein the first pixel, the second pixel and the third pixel are arranged between the two data lines.

9. The display device as claimed in claim 8, wherein the two data lines further have two gate fan-out lines arranged therebetween.

10. A display driving method adapted to be implemented in the display device as claimed in claim 1, the display driving method comprising:

sequentially providing a driving signal to the third gate line, the second gate line and the first gate line in that order, wherein the driving signal comprises a first pulse, a second pulse and a third pulse sequentially generated in that order, pulse widths of the first pulse, the second pulse and the third pulse in that order are progressively increased and time intervals among the first pulse, the second pulse and the third pulse in that order are progressively decreased;

wherein the first pulse of the driving signal provided to the first gate line has a partial time overlap with each of the third pulse of the driving signal provided to the third gate line and the second pulse of the driving signal provided to the second gate line;

wherein the second pulse of the driving signal provided to the first gate line is behind the third pulse of the driving signal provided to the third gate line and has a partial time overlap with the third pulse of the driving signal provided to the second gate line; and wherein the third pulse of the driving signal provided to the first gate line is behind the third pulse of the driving signal provided to the second gate line.

11. The display driving method as claimed in claim 10, wherein the display device further comprises another data line neighboring with the data line, and the display driving method further comprises:

supplying display data with different polarities respectively to the two data lines.

12. A display device comprising:

a plurality of pixels, comprising a first pixel, a second pixel and a third pixel, wherein each of the first pixel, the second pixel and the third pixel comprises a pixel transistor and a pixel electrode electrically coupled to the first source/drain electrode of the pixel transistor;

a first gate line, electrically coupled to the gate electrode of the pixel transistor of the first pixel;

a second gate line, electrically coupled to the gate electrode of the pixel transistor of the second pixel;

a third gate line, electrically coupled to the gate electrode of the pixel transistor of the third pixel; and a data line;

wherein the second source/drain electrode of the pixel transistor of the first pixel is electrically coupled to the data line, the second source/drain electrode of the pixel transistor of the second pixel is electrically coupled to the first source/drain electrode of the pixel transistor of the first pixel, the second source/drain electrode of the pixel transistor of the third pixel is electrically coupled to the first source/drain electrode of the pixel transistor of the second pixel, and the pixel transistor and the pixel electrode of the third pixel are arranged at two opposite sides of the third gate line.

13. The display device as claimed in claim 12, wherein the pixels are colored pixels, and at least two of the first pixel, the second pixel and the third pixel are for displaying different colors.

14. The display device as claimed in claim 13, wherein the colored pixels are arranged in a strip manner.

15. The display device as claimed in claim 13, wherein the colored pixels are arranged in a delta manner.

16. The display device as claimed in claim 12, wherein the first pixel, the second pixel and the third pixel are arranged in different columns from one another, and the columns extend along an extension direction of the data line.

17. The display device as claimed in claim 12, wherein the first pixel, the second pixel and the third pixel are arranged in two columns, and the columns extend along an extension direction of the data line.

18. The display device as claimed in claim 12, wherein the second gate line is neighboring with both the first gate line and the third gate line and located between the first gate line and the third gate line.

19. The display device as claimed in claim 12, further comprising another data line neighboring with the data line, wherein the first pixel, the second pixel and the third pixel are arranged between the two data lines.

20. The display device as claimed in claim 19, wherein the two data lines further have one or multiple gate fan-out lines arranged therebetween.

21. A display driving method adapted to be implemented in the display device as claimed in claim 12, the display driving method comprising:

sequentially supplying a driving signal to the third gate line, the second gate line and the first gate line in that order, wherein the driving signal comprises a first pulse, a second pulse and a third pulse sequentially generated in that order, pulse widths of the first pulse, the second pulse and the third pulse in that order are progressively increased, and time intervals among the first pulse, the second pulse and the third pulse in that order are progressively decreased;

wherein the first pulse of the driving signal supplied to the first gate line has a partial time overlap with each of the third pulse of the driving signal supplied to the third gate line and the second pulse of the driving signal supplied to the second gate line;

wherein the second pulse of the driving signal supplied to the first gate line is behind the third pulse of the driving signal supplied to the third gate line and has a partial time overlap with the third pulse of the driving signal supplied to the second gate line; and wherein the third pulse of the driving signal supplied to the first gate line is behind the third pulse of the driving signal supplied to the second gate line.

22. The display driving method as claimed in claim 21, wherein the display device further comprises another data line neighboring the data line, and the display driving method further comprises:

providing display data with different polarities respectively to the two data lines.

* * * * *